US006201187B1

(12) United States Patent
Burbine

(10) Patent No.: US 6,201,187 B1
(45) Date of Patent: Mar. 13, 2001

(54) PRE-WIRED UNIVERSAL JUNCTION BLOCK

(76) Inventor: Theodore B. Burbine, P.O. Box 197, Mt. Shasta, CA (US) 96067

( * ) Notice: Subject to any disclaimer, the term of this patent is extended or adjusted under 35 U.S.C. 154(b) by 0 days.

(21) Appl. No.: 09/411,010

(22) Filed: Oct. 1, 1999

(51) Int. Cl.[7] ..... H01R 13/46
(52) U.S. Cl. ..... 174/60; 174/53
(58) Field of Search ..... 174/53, 59, 60

(56) References Cited

U.S. PATENT DOCUMENTS

| | | | | |
|---|---|---|---|---|
| 2,397,688 | | 4/1946 | Osinski | 174/53 |
| 2,401,948 | | 6/1946 | Loy | 174/53 |
| 2,433,917 | * | 1/1948 | McCartney | 174/53 |
| 2,531,350 | | 11/1950 | Chrastina | 200/51 |
| 2,828,394 | | 3/1958 | Mayzik | 200/168 |
| 3,038,141 | | 6/1962 | Chiuchiolo | 339/164 |
| 3,365,156 | | 1/1968 | Beck | 248/205 |
| 3,549,783 | * | 12/1970 | Bendrick | 174/59 |
| 3,610,561 | | 10/1971 | Greenwood | 248/205 |
| 3,716,651 | * | 2/1973 | Werner | 174/53 |
| 4,165,443 | | 8/1979 | Figart et al. | 174/53 |
| 4,210,772 | | 7/1980 | Magana et al. | 174/59 |
| 4,295,018 | | 10/1981 | Borrelli | 200/51 |
| 4,425,016 | * | 1/1984 | Denckert | 339/82 |
| 4,918,258 | | 4/1990 | Ayer | 174/53 |
| 5,326,933 | | 7/1994 | Freundner et al. | 174/53 |
| 5,399,806 | | 3/1995 | Olson | 174/53 |
| 5,471,012 | | 11/1995 | Opel | 174/53 |
| 6,027,367 | * | 2/2000 | Woertz et al. | 439/497 |

* cited by examiner

*Primary Examiner*—Dean A. Reichard
(74) *Attorney, Agent, or Firm*—Cahill, Sutton & Thomas P.L.C.

(57) ABSTRACT

A pre-wired junction block incorporates cable receptacles at each of the four corners thereof. The receptacles are adapted to receive the three bare wires of a Romex®-type three wire cable. The junction block is provided with connection holes in a face thereof to receive short rigid jumper wires from electrical fixtures such as electrical outlets and electrical switches. The connection holes are identified on the face of the junction block with indicia to identify the hot and neutral connections of an outlet side of the junction block face, and are identified with indicia to identify connections to a switch side of the junction block face to properly receive the jumper wires of an electrical outlet or the jumper wires of an electrical switch respectively.

11 Claims, 4 Drawing Sheets

PRE-WIRED UNIVERSAL JUNCTION BLOCK

FIELD OF THE INVENTION

The present invention pertains to a means for interconnecting a plurality of electrical conductor cables within a standard junction box, and more specifically, to receive individual wires for connection to electrical fixtures such as electrical outlets, electrical switches and the like.

BACKGROUND OF THE INVENTION

While technology has replaced many commonly used devices with simpler, safer, more efficient applications, the current method of hand-wiring each and every junction box with a tangle of excess wire, wire-nuts, and crimp-on connectors has changed little over the past fifty years. The purpose behind the present invention is to provide a pre-wired junction block, for the interconnection of all incoming and outgoing cables within a standard utility box without the use of excess wire, wire-nuts or crimp-on connectors, while also allowing electrical fixtures such as outlets or switches to be incorporated directly into the same junction without the use of wire-nuts or connectors. Since all of the connections and interconnections between the plurality of cable wires and fixture wires are completed by the internal wiring of the junction block itself, the only hand-wiring required is for the cables and jumper wires to be plugged into the appropriate locations on the junction block. Since most electrical problems which currently arise within hand-wired junction boxes are the result of human error, this device not only increases the safety of the electrical connections, but is faster, cheaper, and far more efficient than the current practice of wiring each and every outlet, switch, and junction box by hand.

The current method of wiring a domestic or commercial building entails running insulated three-wire cables of appropriate gauge (such as those sold under the trademark Romex®) into a standard utility box and leaving lengths of those cables protruding from the front of the box. To complete the connections an electrician must return to each box after the drywall and painting are completed, and identify the function of each of the cables as well as the intended fixtures to be used within the box. A utility knife is then used to cut and strip away the sheathing on the cables back to where they enter the rear of the box, exposing the individual insulated wires. These individual wires must be cut to length and stripped of their respective individual insulation at their tips before being twisted into groups according to their function. The bare tips of each group of wires are brought together and an additional jumper wire are added to each group to service outlets or switches. The groups of wires are then secured together with twist-on wire nuts.

All of the copper "ground" wires from the cables must also be gathered together with an additional jumper wire added if an outlet is to be used, and a special copper "ground connector" must be crimped around them to secure the connection. Since standard cable wires are rigid copper and do not bend very easily, the jumper wires must be kept out of the way while the mass of tangled wires, wire-nuts and connectors, are forcibly crammed into the back of the electrical box in order to make room for the fixture. Since the ground wires are bare copper without any insulation, it is crucial that these wires not be allowed to come into contact with any bare wires which might be protruding from the wirenuts or with the exposed terminals of a fixtures, either of which would cause an electrical short. With all of the wires and connectors crammed into the box the appropriate fixture is then connected to the protruding jumper wires and pushed into the box on top of the mass of wires and wire connectors. Since the terminals of the fixtures remain exposed it is critical that they not be allowed to come into contact with any of the bare ground wires within the box.

While the majority of utility boxes wired in this way function effectively for many years, a percentage can and do develop electrical shorts, which if undetected can lead to wire damage and electrical fires. This is usually due to bare wires protruding from the back of wire-nuts, bare ground wires coming into contact with exposed fixture terminals, or wire-nuts and connectors which came loose while being forcibly crammed into the back of the box. In short, the current system of hand wiring creates the potential for electrical shorts in each and every utility box.

The present invention provides a pre-wired junction block for the interconnection of all incoming and outgoing cables within a standard utility box without the use of excess wire, wire-nuts, or crimp-on connectors, while also allowing electrical fixtures such as outlets or switches to be incorporated directly into the same junction without the use of wire-nuts or connectors. Since all of the connections and interconnections between the plurality of cable wires and fixture wires are completed by the internal wiring of the junction block itself, the only hand-wiring required is for the cable and jumper wires to be plugged into the appropriate locations on the junction block face. Since most electrical problems which currently arise within hand-wired junction boxes are the result of human error, this device not only increases the safety of the electrical connections, but is faster, cheaper, and more efficient than the current practice of wiring each and every outlet, switch, and junction box by hand.

OBJECTS OF THE INVENTION

It is therefore an object of the present invention to provide a means for making a plurality of electrical interconnections within a standard junction box.

It is another object of the present invention to provide a means to increase the safety of a plurality of electrical interconnections within a standard junction box.

It is still another object of the present invention to provide a pre-wired device which reduces the chances of human error in connecting a plurality of electrical wires within a standard utility box.

It is still another object of the present invention to provide a device which permits the interconnection of a plurality of wires within a standard junction box without requiring the use of wire-nuts and the like.

It is still another object of the present invention to provide a means to integrate standard electrical fixtures such as electrical switches and outlets into a plurality of wire connections within a standard utility box without the use of wirenuts, connectors or hand-twisted pairs of wires.

These and other objects and advantages of the present invention will become apparent to those skilled in the art as the description proceeds.

SUMMARY OF THE INVENTION

The present invention is not an electrical box—it is a pre-wired junction block, designed to fit into, and be used within, any and all electrical or utility boxes currently in use. The junction block of the present invention allows four standard three wire cables such as Romexe cables to junction together without the need for hand-wiring, wire-nuts, or crimp-on connectors, yet allows fixtures such as outlets and switches to be connected and to be integrated directly into the junction block without the use of such wire-nuts or connectors. When cable wires and fixture wires are plugged into the appropriate pre-marked locations on the junction block, all of the interconnections between and among the plurality of wires are automatically completed by the internal wiring of the junction block itself and no hand wiring is necessary. Since the junction block completes all of the electrical connections which are currently made by hand, its internal wiring is designed to accommodate any and all functions required within the standard electrical utility box.

The basic design of the junction block of the present invention allows the rigid wires of cables to be stripped at their tips and plugged directly into corners of the block. When these rigid wires are inserted into the receptacles of the junction block, no additional wiring, wire-nuts, or connectors are necessary. If fixtures such as outlets or switches are required, the intended fixture is plugged directly into the pre-marked holes on the face of the junction block. Since the internal wiring of the junction block completes all of the interconnections among the four cables and the fixtures, no hand-wiring or connectors are necessary.

While the prior art system of hand-wiring requires different wiring patterns to accommodate different fixtures, the junction block of the present invention permits one single configuration with the internal wiring automatically making the appropriate changes if and when a fixture such as a switch is plugged into the face of the block. While the prior art system of hand-wiring has no set pattern for incoming and outgoing cables, the invention permits the cables to keep the same configuration in all applications, standardizing one single configuration for all utility box wiring. While the current prior art systems require the wiring process to be halted once the cables have been run and then requires an electrician to return to each box to hand-wire the connections only after the drywall and painting are completed, the junction block of the present invention allows the internal wiring to be fully completed in about one minute at the time the cables are run.

While the prior art system requires a mass of rigid cable wires, jumper wires, and wire-nuts to be forcibly pulled from a pre-existing box and disconnected in order to add an additional cable or replace a damaged fixture, the device of the present invention allows both an additional cable to be added or a damaged fixture to be unplugged from the block and replaced without any disruption of the interconnections of the existing cables. While the prior art system of hand-wiring provides an opportunity for inexperienced homeowners or handymen to make incorrect, poor, or every dangerous electrical connections, the junction block of the present invention requires only that the cables and jumper wires be plugged into the designated pre-marked locations within the block, therefore increasing the safety and reliability of the electrical connections no matter who is making them.

BRIEF DESCRIPTION OF THE DRAWINGS

The present invention may more readily be described by reference to the accompanying drawings in which.

DETAILED DESCRIPTION OF THE INVENTION

Figure 1:
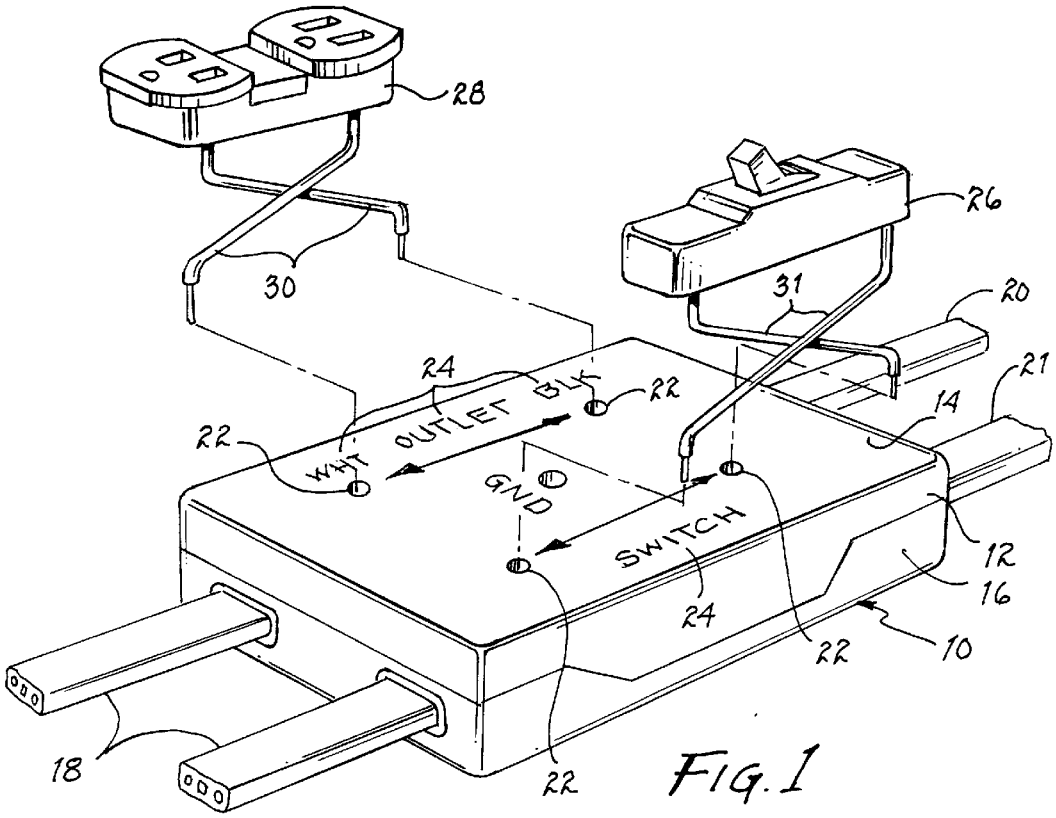
FIG. 1 is a perspective view of a junction block constructed in accordance with the teachings of the present invention showing four three-wire cables inserted into the appropriate corners of a junction block and showing an electrical outlet and an electrical switch positioned to be connected to the face of the block.

Referring to FIG. 1, a perspective view of a junction block constructed in accordance with the teachings of the present invention is shown. The junction block 10 may be formed of any rigid non-conductive material such as any of a variety of forms of plastic materials. The junction block is provided with cable receptacles to receive the individual wires of cables 18 to be inserted into the junction block. The junction block is formed of two sections, an upper section 12 having a face 14, and housing all of the internal wiring components and connectors, and a base plate or lower section 16 housing the guide channels for holding the rigid wires of the cables. The two sections are joined and maintained as a unitary structure through the use of fastening screws extending through holes in the face into corresponding holes provided in the base plate. Each of the outside corners of the junction block are provided with cable receptacles to receive the individual wires of cables 18, 20 and 21 to be inserted directly into the junction block. The insertion of the cables into the designated receptacles automatically connects the individual wires of the cables to the corresponding circuits of the internal wiring of the junction block. The face of the junction block is provided with connection holes 22 for connecting electrically fixtures such as outlets and switches to the internal wiring circuits within the block. The face 14 is also provided with indicia 24 such as markings or notations as shown in FIG. 1 designating the connection holes on one side of the block as "outlet" holes, one of which is identified as a connection hole for receiving a wire to be connected to the black (BLK) or power wire of the cable; the other connection hole on the outlet side of the junction block face is identified as a connection hole for connecting to the neutral or white (WHT) conductor of the cable. The face 14 of the junction block is also provided with indicia 24 indicating another side of the block as the "switch" side with two connection holes 22 to receive the wires of a switch. The face 14 is also provided with a connection hole to receive wires to be connected to the ground conductor of the cable; the indicia for the ground wire is identified as "GND".

If the electrical fixture to be connected to the junction block 10 is an electrical outlet 28, then the outlet is provided with a pair of short rigid jumper wires 30 conformed as shown in FIG. 1 with the respective wires to be inserted into the white and black connection holes 22 on the face of the junction block. And the ground wire (not shown) to be inserted in the connection hole labeled ground or "GND". If the electrical fixture to be connected to the junction block is an electrical switch 26 , similar short jumper wires are connected to the electrical switch and are inserted into the connection holes provided on the switch side of the junction block. The insertion of wires into the "switch" holes on the face of the block causes the internal wiring of the block to automatically disconnect the cable 21 switch leg wire in the upper right corner of the junction block from the main power circuit within the block, causing power to flow through the switch 26 before reaching the designated switch leg cable 21.

The power or source cable 20 is connected into the upper lefthand receptacle (not shown in FIG. 1) provided in the junction block while the cables 18 connected to the receptacles at the opposite end of the junction block are junction cables that can be used to provide a power source to other junction blocks or junction boxes. The fourth cable 21 connected to the junction block may be used as a third junction cable or may be used as a switch leg to be powered only through the operation of the electrical switch 26 as described above.

Figure 2A:
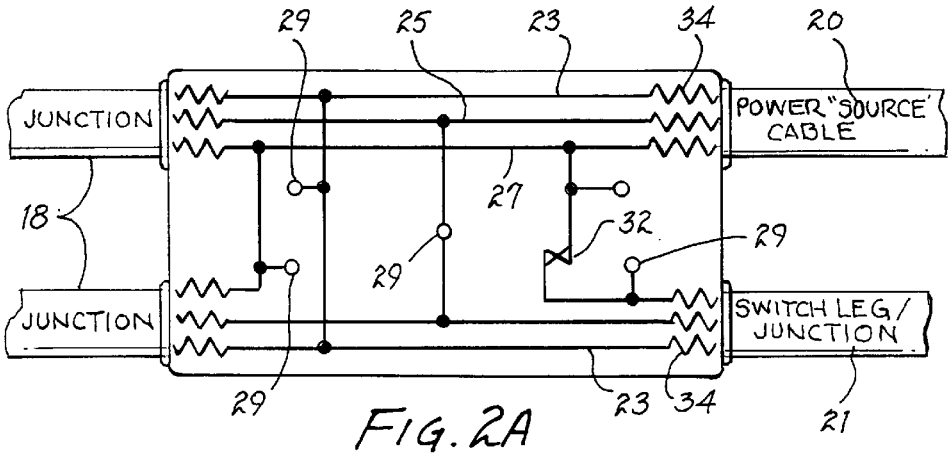
FIG. 2A is as top view of the junction block of FIG. 1 showing the schematic internal electrical wiring within the block.
Figure 2B:
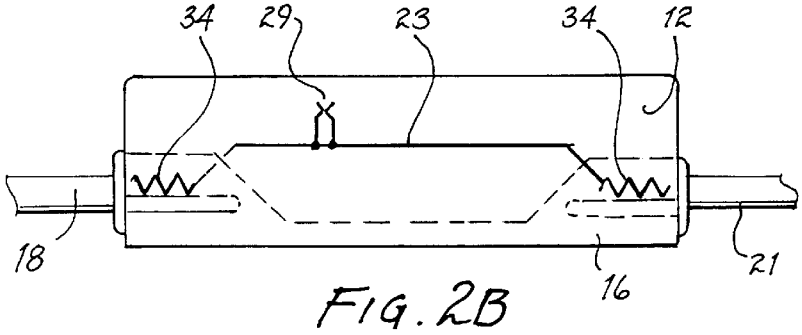
FIG. 2B is a side view of FIG. 2A showing how the internal circuits within the junction block connect with the individual cable wires by means of corrugated connectors.

Referring to FIGS. 2A and 2B, the power or source cable 20 provides electrical power throughout the entire junction block and the internal wiring of the junction block provides interconnection of its hot wire 27 to the corresponding hot wires of the other cables connected to the junction block. Similarly, the neutral or white wire 23 and the ground wire 25 of the power source cable are also interconnected to the respective wires of the other junction cables. However, it may be noted that if the rigid jumper wires of an electrical switch (such as switch 26 in FIG. 1) are inserted into the "switch" connector holes 22 on the face of the block as shown in FIG. 1, internal contacts 32 within the internal power circuit of the block are opened, thus breaking the direct circuit between the power source cable hot wire 27 and that of the switch leg cable 21. The insertion of the rigid jumper wires of the switch 26 into the corresponding holes on the face of the block causes the internal wiring of the block to re-route the power through the external switch 26 to the switch leg cable, therefore requiring the external switch 26 to be switched to a closed position before the hot wire of the switch leg cable 21 receives power. It may be seen that the internal circuits of the switch block correspond to the neutral, ground and hot circuits of the power source cable 20 and are provided with corrugated connectors 34 which connect the individual wires of each of the cables within the junction block. It may also be seen by reference to FIG. 2B that each of the internal conductors are provided with connector means 29 which contact and connect the internal circuits within the junction block to a corresponding fixture jumper wire inserted into the insertion holes on the face of the block.

In the embodiment chosen for illustration, the internal circuitry of the junction block is formed of electrical conductors providing hot wire 27, neutral wire 23 and ground wire 25 together with the internal connections to corresponding conductors for connection to other cables. The ends of these conductors are corrugated to provide corrugated connectors 34 to insure firm contact with the bare wire ends of the cable wires inserted into the junction block. Other techniques may be used to insure firm electrical contact with the cable wires.

Figure 3A:
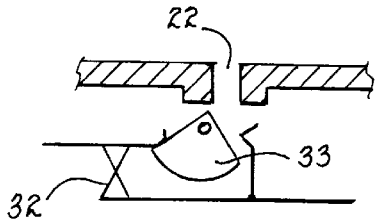
FIGS. 3A and 3B are side sectional views of the designated insertion hole on the face of the block designed to accept one of the jumper wires of a standard switch, useful in describing the operation of the present invention.
Figure 3B:
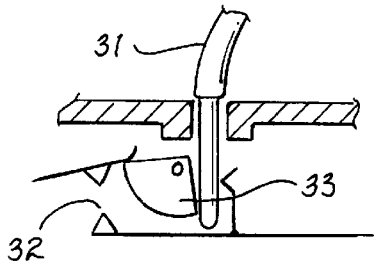

Referring now to FIGS. 3A and 3B, it may be seen that in FIG. 3A no rigid jumper wire has been inserted into the "switch" connection hole 22 in the face of the block, therefore, the internal electrical contacts 32 within the junction block are closed allowing the hot wire 27 of the power source cable 20 to connect directly to the hot wire of the switch leg cable 21 allowing it to function as a standard junction cable. However, in FIG. 3B, a rigid jumper wire 31 of an electrical switch has been inserted into the "switch" hole 22 on the block face. As the rigid jumper wire is inserted into the connection hole 22 it pushes against a non-conductive cam 33 within the hole, causing the cam to rotate to accommodate the insertion of the rigid wire. As the rigid wire is fully inserted the rotation of the cam 33 applies an upward force on one of the internal contacts 32 causing the contacts within the block to open, thus breaking the direct circuit between the hot wire of the power cable and the switch leg cable. With the direct power circuit to the switch leg broken by the insertion of the jumper wires, the internal wiring of the junction block automatically re-routes the power through the external switch 26 so that power to the hot wire for the switch leg cable 21 will be applied only if the external switch 26 is closed. The technique used to open the internal switch 32, and the structure of the switch 32 may take any of a variety of forms; many techniques that have been used in the prior art for other types of electrical equipment may be implemented in the junction block to cause the opening of the internal switch 32 as shown schematically in FIGS. 3A and 3B.

Figure 4:
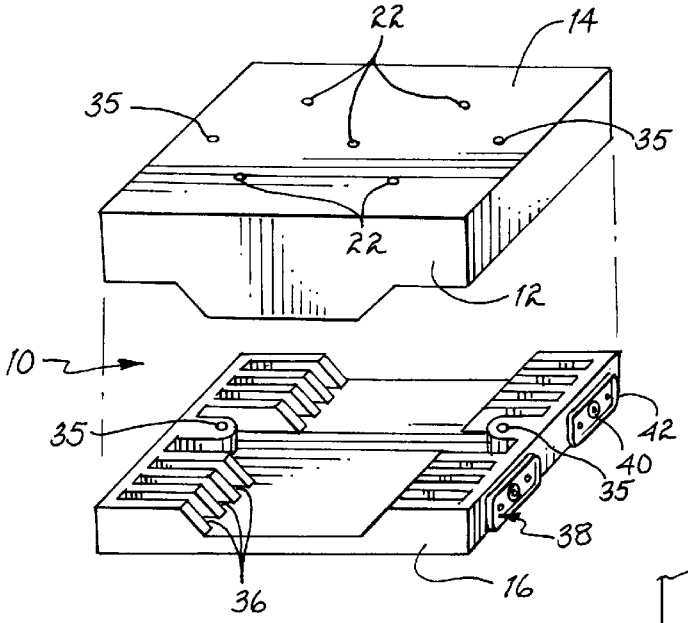
FIG. 4 is an exploded isometric view of a junction block constructed in accordance with the teachings of the present invention, showing both the enclosed upper block face and the internal construction of the lower base plate.

FIG. 4 is an exploded view of a junction block such as that shown in FIG. 1 to reveal the internal construction of the junction block. The upper section 12 of the junction block 10 contains the connection or insertion holes 22 as previously described to receive the short rigid jumper wires of the electrical fixtures such as electrical outlets or electrical switches. The upper section 12 of the junction block also contains all of the internal wiring of the junction block including the corrugated connectors which complete the connections between the internal wiring of the block and the individual cable wires housed within the guide channels of the lower section or base. The upper section of the junction block also contains fastening screw holes 35 to receive fastening screws which extend from the upper section into the lower section or base 16 of the junction block to secure both sections together. The bottom section or base 16 houses the cable conductor channels 36 to receive the bare wires of the cables extending therein. The base 16 is provided with four cable receptacles 38, each having three openings to receive the three bare wires of the cables and to guide those wires into the respective conductor channels 36. Since the upper section 12 contains all of the internal wiring of the block, including the corrugated connectors 34 which extend downwardly to make contact with the individual cable wires within the guide channels of the lower section or base 16, a damaged block may therefore easily be removed by means of fastening screws 52 and replaced with a new block without any disturbance to the individual wires of the cables housed within the lower section or base. It may also be seen that the cable receptacles 38 within the lower section or base 16 incorporates safety cones 40 on the exterior of the base to bear against the insulation of the bare ground wire to insure that it is shielded from contact with adjacent wires and thereby prevent "shorting". A larger safety ring 42 also surrounds the outside of the receptacle to insure that none of the bare wires are exposed externally of the junction block.

Figure 5:
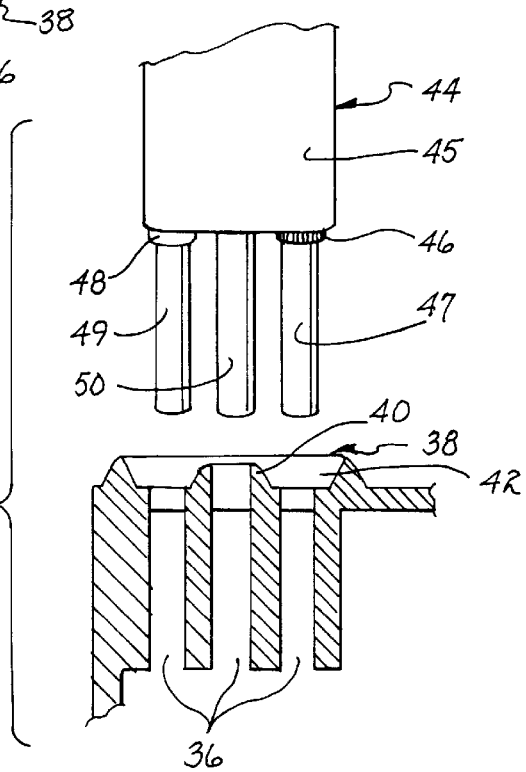
FIG. 5 is a cross-sectional view of a portion of the junction block of the present invention showing the conductor channels and safety cones opposing the bare wires of a cable to be inserted into the junction block.

A greater detail of the cable receptacles may be seen by reference to FIG. 5 wherein it may be seen that the cable 44 is shown having the insulation stripped away and having the hot-wire 47, neutral wire 49, and ground wire 50 extending from the cable sheath insulation 45. The hot-wire retains a portion of the individual wire insulation 46 in black and the neutral wire has a portion of the individual wire insulation 48 in white retained. The cable has been stripped of the cable sheath insulation 45 to expose the individually insulated wires extending therefrom and the insulation on the wires has been stripped to expose the bare metal wire. The three wire cable end is then inserted into the conductor channels 36 within the block with the safety cone 40 extending up under the sheathing of the cable to protect the ground wire from possible contact with either of the other wires. The safety ring 42 extends around the hole of the cable end to protect and prevent any possible contact between foreign objects and any portion of the wires with might remain exposed. The bare wires thus extending into the corresponding conductor channels within the junction block are then secured in place through the utilization of the previously mentioned fastening or clamping screws.

Figure 6:
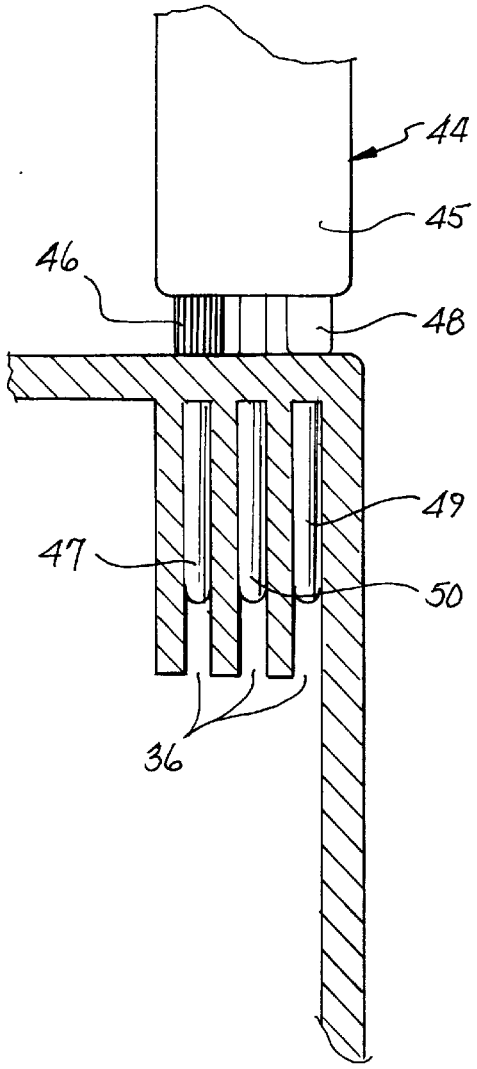
FIG. 6 is a partial cross-sectional view of a portion of the junction block of the present invention showing the conductor channels having the bare metal wires of a cable inserted therein.
Figure 7:
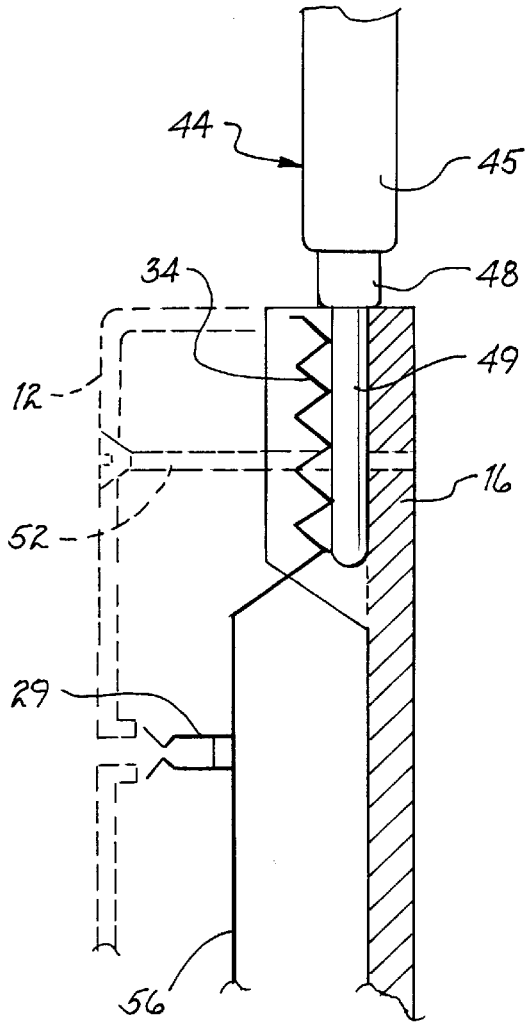
FIG. 7 is a schematic illustration of a portion for the junction block of the present invention showing an internal connector for connecting a bare metal wire of a cable with the internal wiring of the junction block and showing a fastener or clamping screw for clamping the two sections of the junction block.

Referring to FIGS. 6 and 7, a Romex-type cable 44 is shown having the bare wires 47, 49 and 50 thereof extending into conductor channels 36 within the base 16 of the junction block (the safety cones are omitted from FIGS. 6 and 7 for simplicity). The upper section 12 of the junction block (shown in broken lines in FIG. 7) is then tightened down on the lower section 16 of the junction block through the use of the previously mentioned fastening screws 52. As the two sections of the junction block are secured in face-to-face contact, corrugated metal connectors 34 within the upper section 12 press downward onto each of the conductor channels 36 within the lower section or base 16. Each individual corrugated connector 34 is connected to the corresponding circuits of the internal wiring contained within the upper section 12 of the block, and as each corrugated connector presses downward into the corresponding conductor channel 36 it contacts the bare wire of the corresponding cable wire positioned within that conductor channel. As the previously mentioned fastening screws are tightened, each of the individual corrugated connectors are pressed firmly downward against the corresponding bare wire within that channel, completing the electrical connection and securing the wire in place. The internal wiring of the junction block may take several forms; the present embodiment comprises three conductive metal strips 23, 25 and 27 (FIG. 2A) having corrugated connectors 34 at each of their ends which form the contacts with the individual cable wires within the guide channels for the lower section or base 16. The three metal strips 23, 25, 27 each run the length of both sides of the block with cross-over ties joining both sides together, and together comprise three separate conductive circuits within the block constituting the hot, neutral, and ground circuits.

Working with prior art wiring systems, there are no set configurations for either incoming or outgoing cables within a utility box, and it is therefore not possible for anyone working on a prior art utility box to know precisely which cable is the "power" or source cable and which cable exits to additional junction boxes. The electrician must first identify which of the cables within a utility box is the main power cable and which are the junction cables. The pre-wired block of the present invention always uses the exact same configuration for the source cable, junction cables, and switch leg thereof, therefore, anyone working on a previously wired utility box fitted with the block of the present invention can instantly identify the origin and purpose of each of the incoming or outgoing cables. In the junction block of the present invention, the cable in the top left corner is always the power or "source" cable, carrying power to the entire block The cable in the top right corner is always the designated location for an outgoing switch leg, since this top right leg automatically disconnects from direct power if an external switch is plugged into the face of the block. If no switch is plugged into the face of the junction block of the present invention, then the top right leg will automatically receive direct power from the power cable and function as a normal junction to carry power to other fixtures at other locations. Cables entering the bottom two corners of the junction block are always assigned as "junction" cables and carry power out to other fixtures.

When the four cables are plugged into the designated locations on the junction block of the present invention it becomes fully operational as a four-way junction, the power coming in through the top left corner and flowing out through the other three cables. If an electrical switch is to be used within the box, the cable intended to be used as a switch leg has been inserted into the top right corner of the junction block since this leg automatically becomes disconnected from direct power when a switch is plugged into the face of the block.

It is also important to note that the connection holes on the face of the junction block of the present invention are always provided with indicia or markings indicating which connection holes are to be used for "outlets" and which of the "outlet" connection holes is to be connected to the black or hot wire and which is to be connected to the neutral or white wire (and which is to be connected to the ground wire). In working on previously wired electrical boxes having connections constructed in accordance with the prior art, it is not at all uncommon to find that an inexperienced individual has unknowingly reversed the polarity on a switch or an outlet. While the switch may work when wired in this fashion, the problem shows up when someone later turns the switch off and begins working on a light fixture or an electrical outlet controlled by the switch. Since only the neutral leg has been interrupted, the black or hot wire continues to send full voltage and power to the fixture creating an extremely dangerous situation for an unsuspecting individual. Since the pre-wired junction block of the present invention automatically connects all incoming and outgoing wires to the correct polarity, and since all connection points on the block itself are clearly marked for black and white wires, the possibility of reversing the polarity is significantly reduced.

Figure 8:
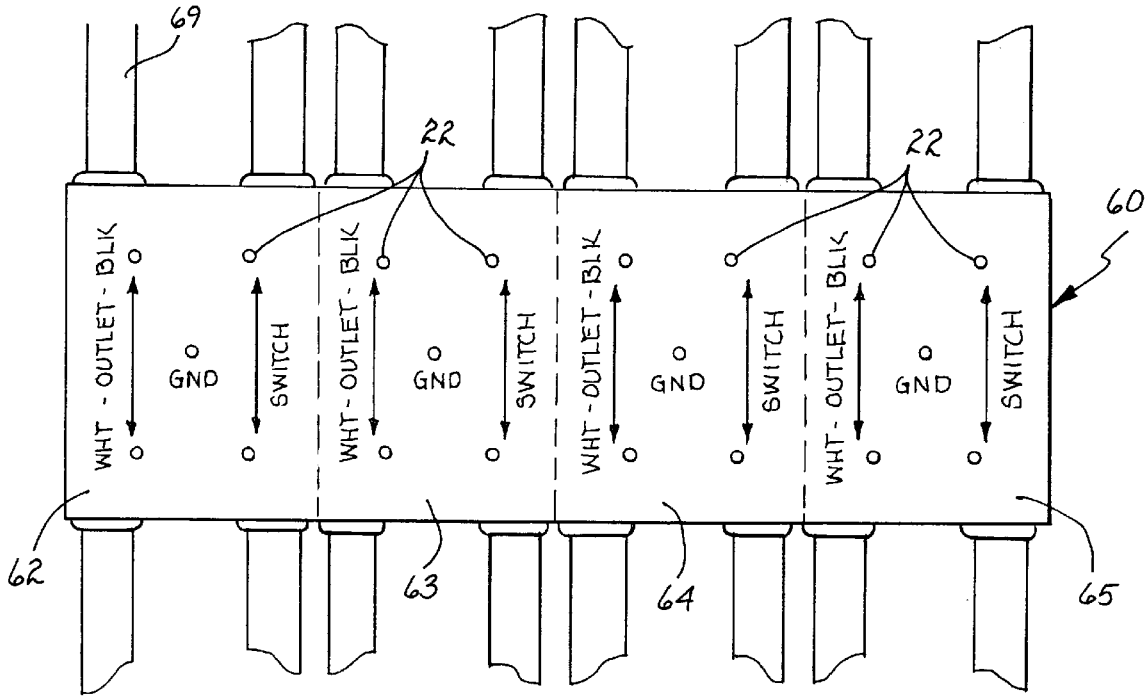
FIG. 8 is a top view of a junction block for use with a multi-fixture electrical box showing four junction blocks together forming a unitary structure.
Figure 9:
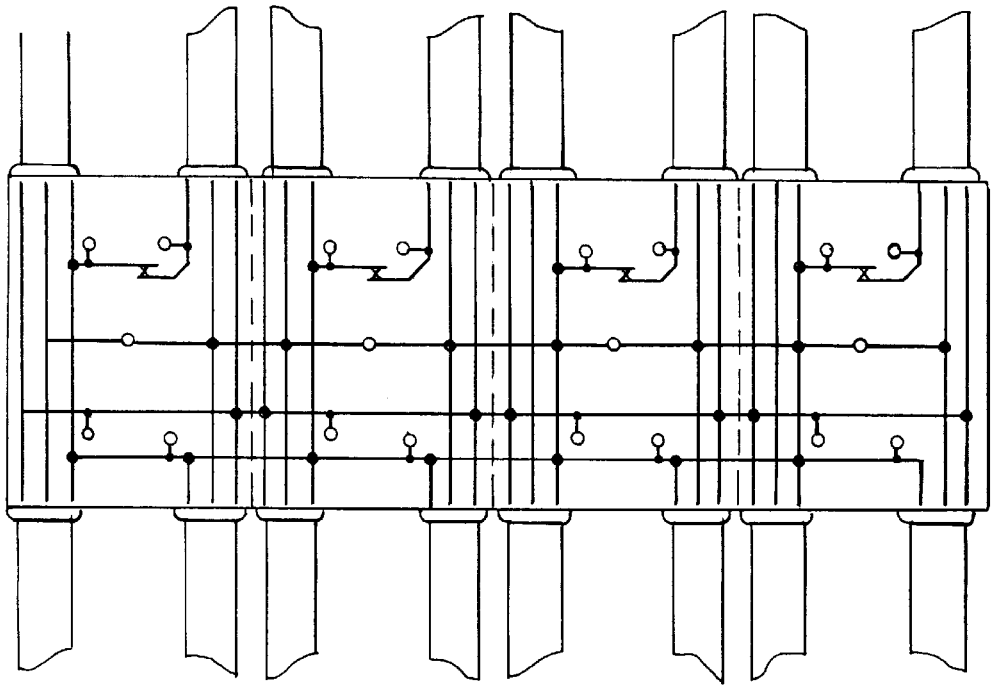
FIG. 9 is a top view of the junction block of FIG. 8 showing the internal wiring of the multi-fixture junction block of the present invention.

Electrical wiring found in both residential and commercial structures frequently call for several fixtures to be contained within a single utility box. To accommodate such multiple fixture utility boxes, a multi-fixture junction block 60 such as shown in FIG. 8 may be used. The internal wiring of the multi-fixture junction block of FIG. 8 is shown in FIG. 9. It may be noted that this multi-fixture junction block 60 is a four fixture block incorporating four single junction blocks 62–65, respectively, of the type described in connection with the preceding figures. However, it is important to note that only a single power or source cable 69 is needed for the entire multi-junction block. That is, the Romex-type cable 69 connected to the upper lefthand corner of the first junction block 62 is the power or source cable; all of the power coming into this multi-fixture utility junction block 60 is supplied by that single power cable 69. All of the corresponding ground wires, neutral wires, and hot wires of all the junction blocks are interconnected as shown in FIG. 9. Further, the face of each junction block is arranged so that each individual junction block is provided with the same indicia on the face designating connection holes 22 as white or black for connection to an outlet fixture, the term "switch" to indicate the two connection holes for connection a switch fixture, and the term "ground" to indicate the connection hole for connecting to the mutual ground of the multi-fixture junction block.

The present invention has been described in terms of a selected specific embodiment incorporating details to facilitate the understanding of the principles of construction and operation of the invention. Such reference herein to a specific embodiment and details thereof is not intended to limit the scope of the claims appended hereto. It will be apparent to those skilled in the art that modifications may be made in the embodiment chosen for illustration without departing from the spirit and scope of the invention.

What is claimed is:

1. A pre-wired junction block for connecting a power or source multi-wire cable to other cables and to electrical fixtures comprising:

(a) a block of insulating material having an upper section including a face and an opposing base section;

(b) said block including a plurality of receptacles each for receiving wires of one of a plurality of multi-wire cables, one of said cables being a source cable and all cables having a hot wire, and a neutral wire;

(c) means in said block connecting the hot, and neutral wires of said power or source cable to the hot, and neutral wires of each of the other cables respectively;

(d) said face having a plurality of connection holes therein for receiving rigid jumper wires;

(e) said holes arranged with indicia on said face to permit each of said rigid jumper wires to be selectively inserted in a different one of said connection holes respectively and electrically connected to the hot wire and neutral wire respectively of said source cable, wherein an electrical fixture may be electrically connected to said power or source cable.

2. The combination set forth in claim 1 wherein said other cables are three wire cables each having a hot wire, a neutral wire and a ground wire.

3. The combination set forth in claim 1 wherein the junction block includes four receptacles, one of said receptacles being designated as a source cable receptacle.

4. The combination set forth in claim 1 wherein the connection holes in said face are arranged having indicia indicating a black or hot connection hole and a white or neutral connection hole to permit the selective insertion of rigid jumper wires into the respective hole.

5. The combination set forth in claim 1 wherein said electrical fixture is an electrical outlet.

6. The combination set forth in claim 1 wherein said electrical fixture is an electrical switch.

7. A pre-wired junction block for connecting a power or source multi-wire cable to other cables and to electrical fixtures comprising:

(a) a block of insulating material having an upper section including a face and an opposing base section;

(b) said block including a plurality of receptacles each for receiving wires of one of a plurality of multi-wire cables, one of said cables being a source cable and all cables having a hot wire, a neutral wire, and a ground wire;

(c) means in said block connecting the hot, neutral and ground wires of said power or source cable to the hot, neutral and ground wires of each of the other cables respectively;

(d) internal switch means in said block connecting the hot wire of said power or source cable to the hot wire of a designated different one of said plurality of cables;

(e) said face having a plurality of connection holes therein for receiving rigid jumper wires;

(f) said holes arranged with indicia on said face to permit each of said rigid jumper wires to be selectively inserted in a different one of said connection holes and electrically connected to the hot wire, neutral wire and ground wire respectively of said power or source cable, the insertion of a selected jumper wire into a selected connection hole opening said internal switch whereby an external electrical switch may be electrically connected to said power or source cable.

8. A pre-wired junction block for connecting a power or source multi-wire cable to other cables and to electrical fixtures comprising:

(a) a plurality of blocks of insulating material each having an upper section including a face and an opposing base section, said blocks connected forming a multi-fixture junction block having a unitary structure;

(b) each block including a plurality of receptacles each for receiving wires of one of a plurality of multi-wire cables, all cables having a hot wire, a neutral wire, and a ground wire, only one of said blocks having a receptacle for receiving the wires of said power or source cable;

(c) means in each of said blocks connecting the hot, neutral and ground wires of said power or source cable to the hot, neutral and ground wires of each of the other cables respectively;

(d) internal switch means in each of said blocks connecting the hot wire of said power or source cable to the hot wire of a designated different one of said plurality of cables;

(e) each of said faces having a plurality of connection holes therein for receiving rigid jumper wires;

(f) said holes of each of said faces arranged with indicia on the respective face to permit said rigid jumper wires to be selectively inserted in different ones of said connection holes and electrically connected to the hot wire and neutral wire respectively of said power or source cable, the insertion of a selected jumper wire into a selected connection hole opening said internal switch whereby an external electrical switch may be electrically connected to said power or source cable.

9. The combination set forth in claim 8 wherein each of the blocks of the multi-fixture junction block includes four receptacles and only one of said blocks includes a receptacle designated as a source cable receptacle.

10. A pre-wired junction block for connecting a power or source multi-wire cable to other cables and to electrical fixtures comprising:

(a) a plurality of blocks of insulating material each having an upper section including a face and an opposing base section, said blocks connected forming a pre-wired multi-fixture junction block having a unitary structure;

(b) each block including a plurality of receptacles each for receiving wires of one of a plurality of multi-wire cables, all cables having a hot wire, a neutral wire, and a ground wire, only one of said blocks having a receptacle for receiving the wires of said power or source cable;

(c) means in each of said blocks connecting the hot, neutral and ground wires of said power or source cable to the hot, neutral and ground wires of each of the other cables respectively;

(d) internal switch means in each of said blocks connecting the hot wire of said power or source cable to the hot wire of a designated different one of said plurality of cables;

(e) each of said faces having a plurality of connection holes therein for receiving rigid jumper wires;

(f) said holes of each of said faces arranged with indicia on the respective face designating a hot, neutral or switch connection hole to permit said rigid jumper wires to be selectively inserted in different ones of said connection holes and electrically connected to the hot wire and neutral wire respectively of said power or source cable, the insertion of a selected jumper wire into a selected switch connection hole opening said internal switch whereby an external electrical switch may be electrically connected to said power or source cable.

11. The combination set forth in claim 10 wherein each of the blocks of the multi-fixture junction block includes four receptacles and only one of said blocks includes a receptacle designated as a source cable receptacle.

* * * * *